US005323957A

United States Patent [19]

Roosa

[11] Patent Number: 5,323,957

[45] Date of Patent: Jun. 28, 1994

[54] HEXAGONAL CIGARETTE CONTAINER

[75] Inventor: Paul D. Roosa, Saugerties, N.Y.

[73] Assignee: International Paper Company, Purchase, N.Y.

[21] Appl. No.: 56,498

[22] Filed: May 4, 1993

[51] Int. Cl.[5] ..... B65D 5/06

[52] U.S. Cl. ..... 229/110; 229/232; 206/264

[58] Field of Search ..... 229/160.1, 110, 232; 206/243, 264

[56] References Cited

U.S. PATENT DOCUMENTS

| | | | |
|---|---|---|---|
| 1,306,574 | 6/1919 | Boerlin . | |
| 2,593,143 | 4/1952 | Hendrick | 229/110 X |
| 3,438,564 | 4/1969 | Moreton | 229/160.1 |
| 4,283,001 | 8/1981 | Meyers | 229/110 |
| 4,418,861 | 12/1983 | McFarland et al. | 229/110 X |
| 4,753,384 | 6/1988 | Focke et al. . | |
| 4,763,779 | 8/1988 | Focke et al. . | |
| 4,779,723 | 10/1988 | Focke et al. . | |
| 4,836,438 | 6/1989 | Rigby | 229/232 X |
| 4,850,527 | 7/1989 | Church et al. | 229/110 |
| 4,895,251 | 1/1990 | Focke et al. . | |
| 5,143,282 | 9/1992 | Pham . | |

FOREIGN PATENT DOCUMENTS

| | | | |
|---|---|---|---|
| 712899 | 7/1965 | Canada | 229/232 |

*Primary Examiner*—Allan N. Shoap
*Assistant Examiner*—Christopher McDonald
*Attorney, Agent, or Firm*—Michael J. Doyle

[57] ABSTRACT

In a first embodiment, a flip top container of partially irregular hexagonal transverse cross section is formed from a unitary blank of paperboard or other stiff, foldable and resilient sheet material. In a second embodiment of the container, another unitary blank of paperboard is employed to form a cigarette container having the same partially irregular hexagonal transverse cross sectional shape, except that a panel having tongue which is reclosable after opening is employed in lieu of a flip top closure.

9 Claims, 4 Drawing Sheets

FIG. 2
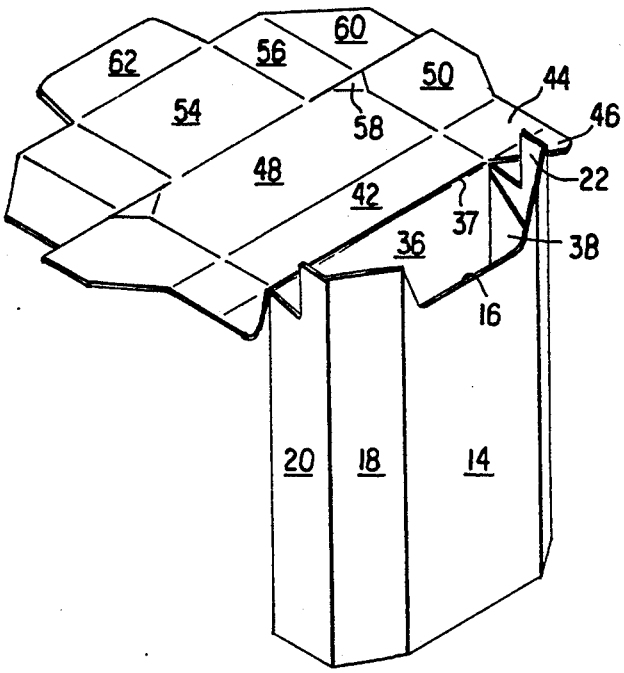
FIG. 4
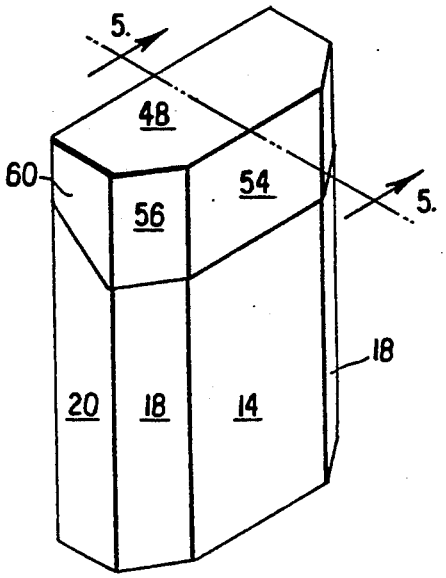
FIG. 3
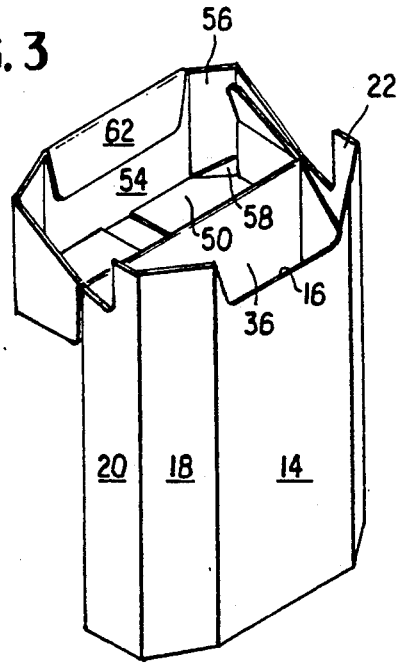
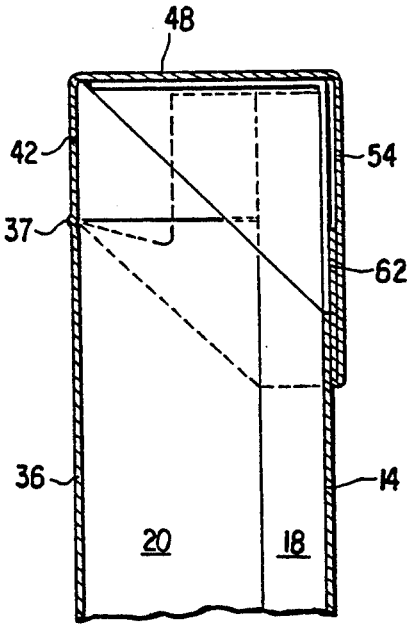
FIG. 5

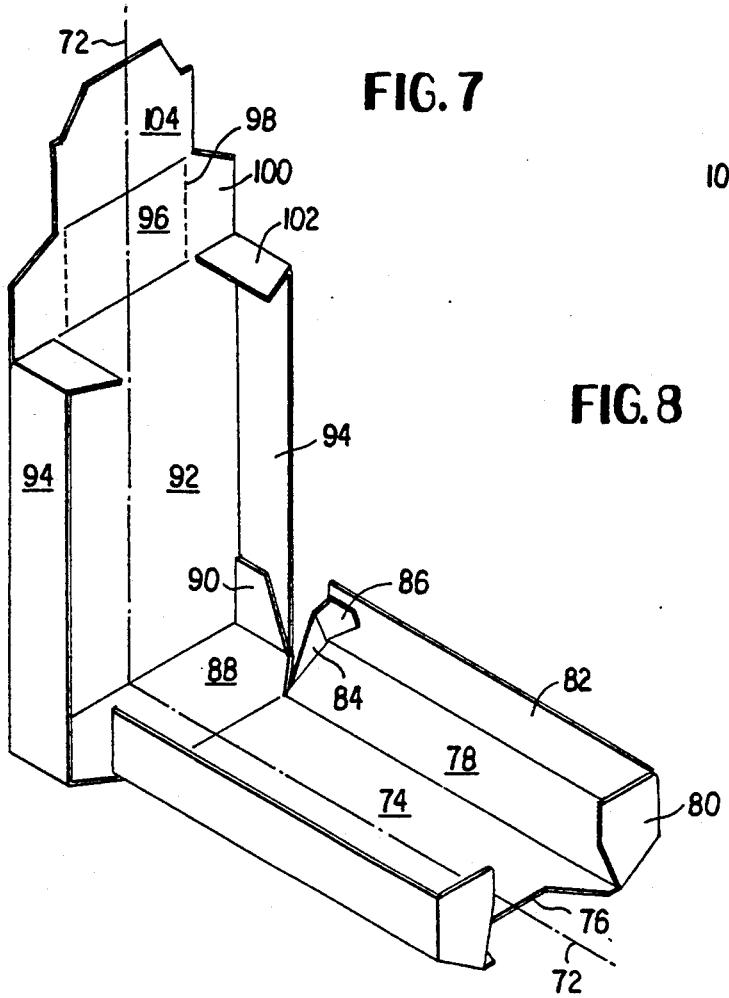
FIG. 7
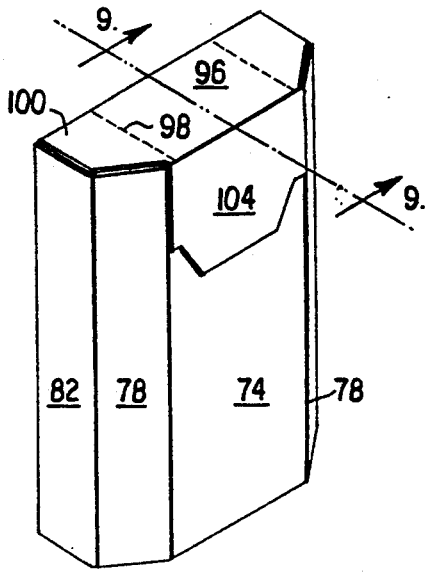
FIG. 8
FIG. 9
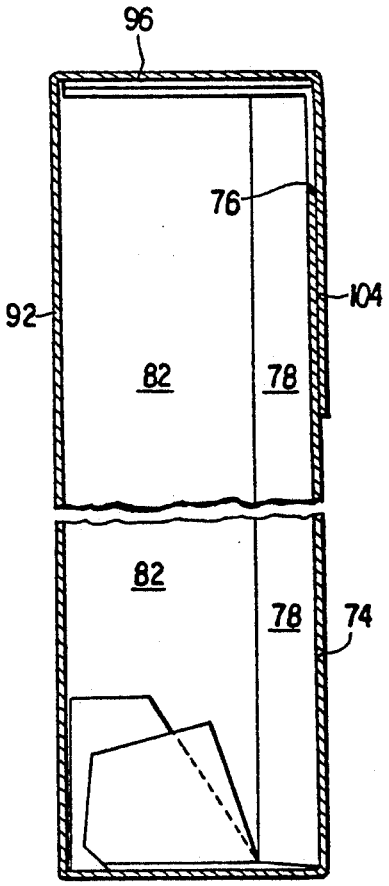
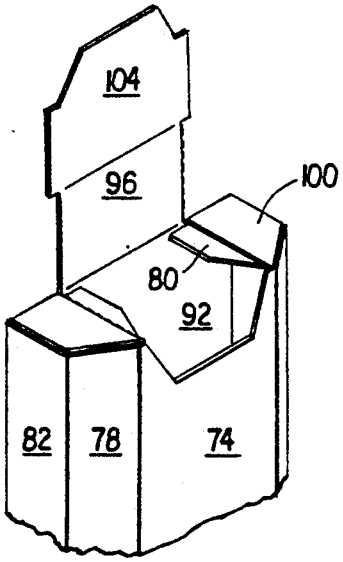
FIG. 10
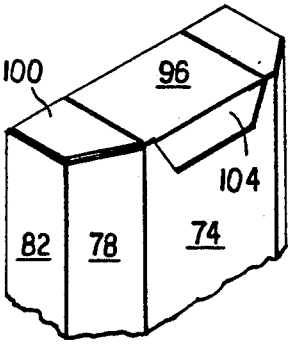
FIG. 11

HEXAGONAL CIGARETTE CONTAINER

BACKGROUND OF THE INVENTION

This invention relates to paperboard containers and more particularly to a paperboard container fashioned from an integral blank of paperboard and formed into a hexagonal cigarette carton of the flip top type.

Flip top cigarette containers formed of paperboard are known and are generally defined by a rectangular body and a hinged lid, with the body often having an internal collar insert which extends above the top edge of the front wall and sides of the container. A flip top lid is hinged to the rear wall of the container by a living hinge, with the lid having a top flat closure and three depending walls, one of which is a front wall and the other two of which are side walls. The overall configuration is that of a rectangular parallelepiped.

Cigarette containers are also known which do not include a flip top closure having a living hinge but which have the same general configuration of a rectangular parallelepiped and a top closure.

SUMMARY OF THE INVENTION

According to the practice of this invention, a flip top type cigarette carton is so configured so as to present a hexagonal transverse cross sectional shape, exhibiting the form of an irregular hexagon. The rear wall of the container is the longest side, with the front wall being the next longest side, the front wall having sloping front portions at its sides, the later joining respective side walls. The transverse shape or form is the same for the lower as well as the upper or flip top portion of the carton.

In an embodiment, the same general transverse shape of the container is preserved, namely, a transverse cross section of an irregular hexagon, while the upper closure carries a tongue for insertion into the interior of the carton. In the second embodiment, the top closure does not include depending front and side wall portions.

BRIEF DESCRIPTION OF THE DRAWINGS

FIG. 2 illustrates the blank of FIG. 1 after it has been partially set up and glued.

FIG. 3 is a view similar to FIG. 2 and illustrates the container of this invention after all gluing and setting up operations have been completed, FIG. 3 showing the container in an open configuration.

FIG. 4 shows the container of this invention in its closed configuration.

FIG. 5 is a sectional view taken along 5—5 of FIG. 4.

FIG. 7 is a view illustrating the blank of FIG. 6 partially set up and glued.

FIG. 8 illustrates the final erected configuration of the container.

FIG. 9 is a view taken along section 9-9 of FIG. 8.

FIG. 10 shows the upper portion of the container after it has been initially opened.

FIG. 11 is a view similar to FIG. 10 and illustrates the container after it has been reclosed.

DETAILED DESCRIPTION OF THE INVENTION

Figure 1:
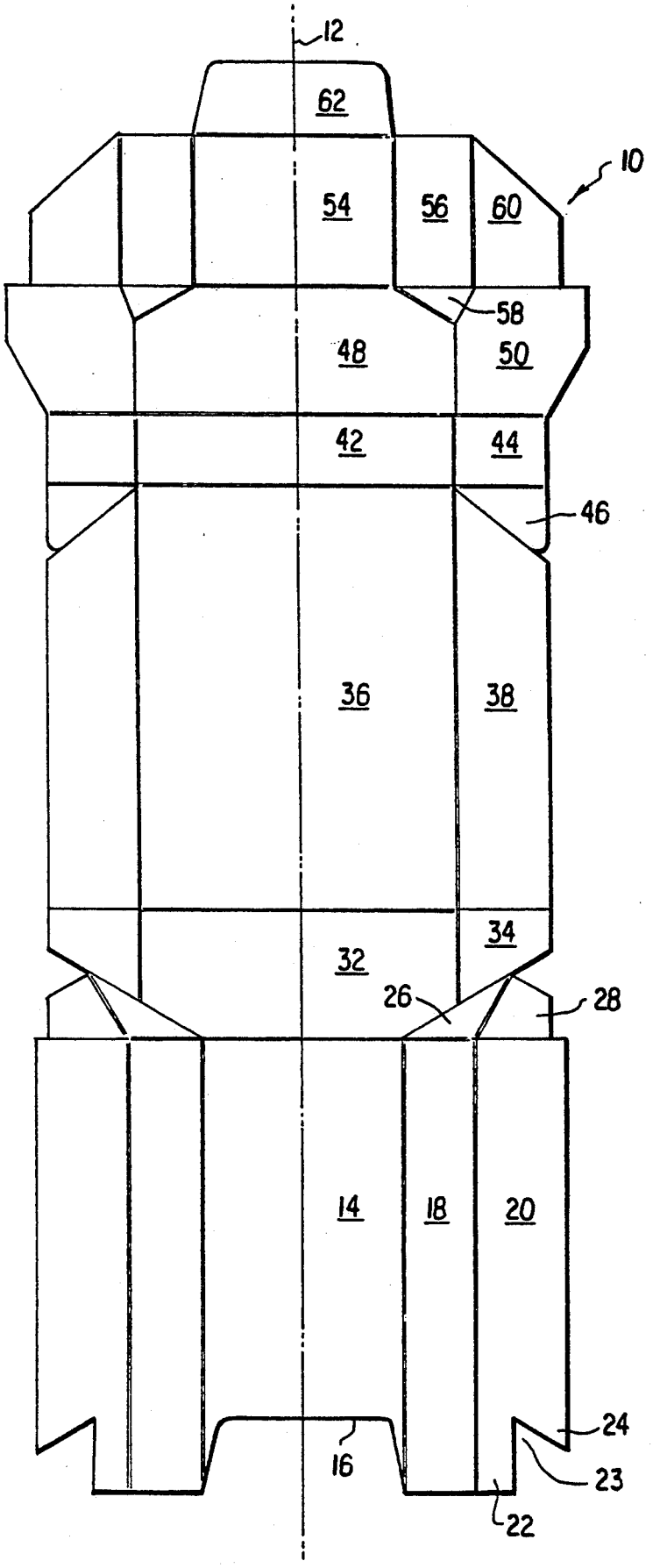
FIG. 1 is a plan view of a unitary blank for forming a flip top carton in accordance with this invention.

Referring now to FIG. 1 of the drawings, the numeral 10 denotes a unitary blank of paperboard or other stiff, resilient and foldable sheet material from which the cigarette carton of this invention is fashioned. The blank includes a longitudinal axis of symmetry 12 about which the blank exhibits mirror symmetry. Accordingly, a single reference numeral for the several panels now to be described will suffice, the same panel structure being present to the left of axis 12 as to the right.

In general, the blank 10 includes a plurality of fold lines, designated as double lines narrowly spaced from each other, and cut lines, shown as solid, which designate a complete severance or cutting through of the paperboard. The several cut and the several fold or hinge lines will, in general, not be designated by reference numerals.

A front wall forming panel 14 has at its lower end a free edge which is provided with a recess 16. Panels 18 are laterally foldably secured to panel 14, while panels 20 are laterally foldably secured to respective panels 18. The lower end of each of panels 20 are cut to define recesses 23, with the uncut lower extremities designated as 22 and tip portions designated as 24. The upper portion of respective panels 18 each foldably carry a lateral panel 26, the latter foldably secured to lateral panels 28. It will be observed that panels 20 and 28 are separated by a cut.

Hexagonal bottom forming panel 32 is provided at each of its sides with a foldable panel 34. Panel 32, as well as panel 48, is termed an irregular hexagon since not all sides are equal, although four of its six sides are parallel. This is the meaning of the phrase irregular hexagonal shape. Rear wall forming panel 36 is provided at each of its sides with a foldable panel 38. Rear top closure panel 42 is foldably secured to the top of panel 36, with panel 42 carrying two lateral panels 44 each foldably attached to a respective lateral panel 46. It will be observed that panels 38 and 46 are separated by a cut line.

Top closure hexagonal panel 48 is bordered on both lateral sides by a cut line, with panels 50 being on either side of these respective cut lines. Lateral panels 58 are foldably secured to respective side portions of panel 48. It will be observed that lateral panels 50 are foldably secured to respective lateral panels 44. Front top closure panel 54 is foldably secured to the top of panel 48, with the sides of panel 54 foldably secured to respective lateral panel 56, the latter foldably secured to each of respective panels 60. It will be observed that there is a cut line between panels 50 and 58, and a cut line between panels 50 and 60. The top of panel 54 carries an inner front top closure panel 62, the latter foldably secured to the former.

The lower portion or section of blank 10 includes panels 14, 18, 20, 26, and 28. The middle portion or section of blank 10 includes panels 32, 34, 36, 38, 42, 44, 46, and 50. The upper portion or section of blank 10 includes panels 48, 54, 56, 48, 60, and 62.

Referring now to FIG. 2 of the drawings, the blank of FIG. 1 has been folded and partially glued to assume the indicated configuration. It will be observed that front wall panel 14 is parallel to rear wall panel 36, with side panels 20 being at right angles to panels 14 and 36, and panels 18 making an acute angle with both panels 20 and 14. The lower body of the container has been formed.

Referring now to FIG. 3, the remainder of the flip top closure forming panels shown at the top of FIG. 2 have been folded and glued to the indicated configuration to form a flip top closure. FIG. 3 shows the assembled cigarette container of this invention in the open configuration. When the flip top lid is closed, the container assumes the configuration as shown in perspective at FIG. 4.

FIG. 5 is a sectional view taken along section 5—5 of FIG. 4. The living hinge 37 is clearly shown, a characteristic of a flip top closure.

It will be observed that the transverse cross section of the container shown at FIGS. 2–4 is of irregular hexagonal shape. Front and rear walls 14 and 36 are parallel, as are side walls 20, with sloping front walls 18 making an angle with both of these directions. It will be readily observed that the container of this invention exhibits a distinctive and readily identifiable shape or profile.

Figure 6:
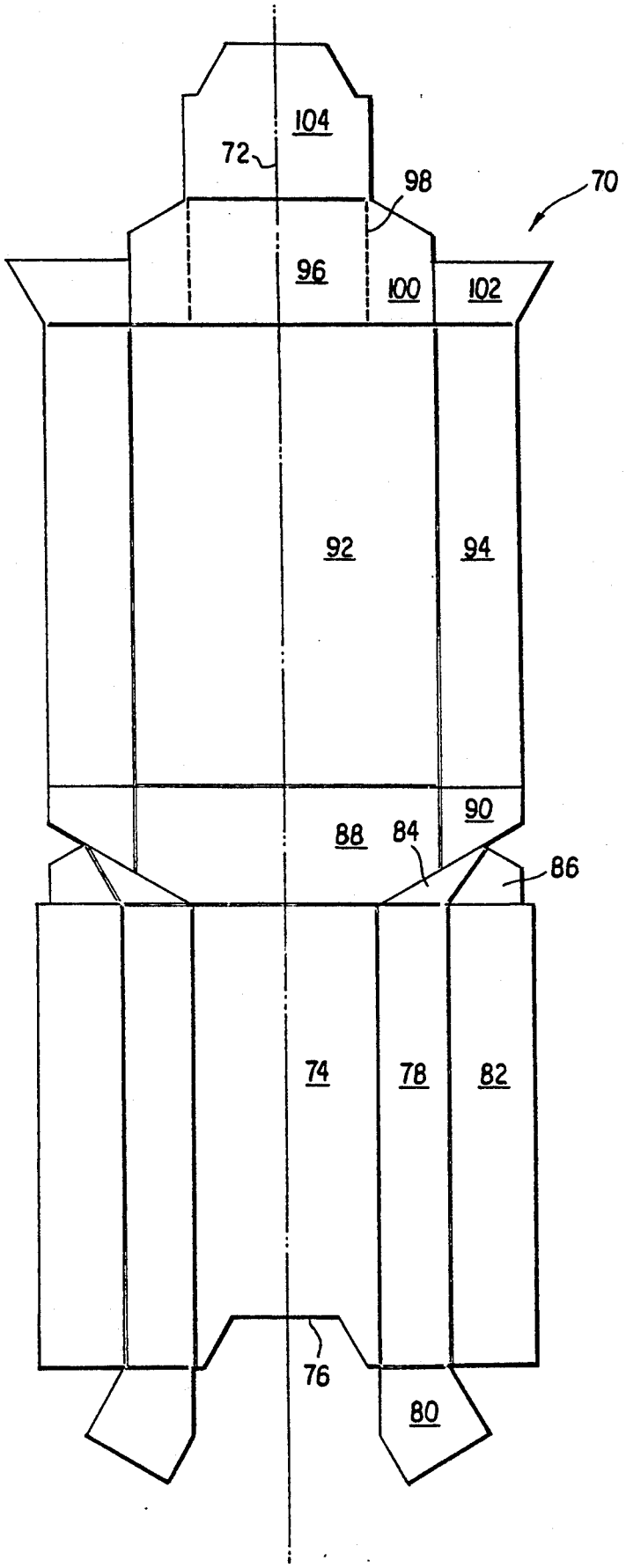
FIG. 6 is a plan view of a unitary blank of paperboard performing a cigarette carton according to a second embodiment of this invention.

Referring now to FIG. 6 of the drawings, a blank of paperboard similar to that of blank 10 is shown. This second blank is designated as 70 and also exhibits a longitudinal mirror axis of symmetry, this axis designated as 72. Again, only those panels to the right of mirror axis 72 will be numbered, as being sufficient also to describe those on the left of this axis. This blank will form a cigarette carton defining a second embodiment.

The numeral 74 designates a front wall forming panel having a lower free edge, the latter provided with a recess 76. Lateral panel 78 is foldably secured to panel 74, with panel 80 foldably secured to the bottom of panel 78. Another lateral panel 82 is foldably secured to one edge of panel 78. Panel 78 is foldably secured at its upper edge to lateral panel 84, the latter foldably secured to panel 86. It will be observed that panel 86 is separated from the top of panel 82 by cut line. Hexagonal bottom forming panel 88 foldably carries lateral panels 90 at its edges. Rear wall forming panel 92 is foldably secured to panel 88, while the sides of rear forming panel 92 are foldably secured to lateral panels 94. It will be observed that there is a cut line between panels 94 and 90. Top closure forming panel 96 is provided with a pair of spaced, vertical and parallel perforated lines 98, with the outermost lateral sections of top closure panel 96 designated as 100. A cut line is between panel portions 100 and panels 102, the latter foldably secured to the top of panel 94. Tongue closure forming panel 104 is foldably secured to panel 90. The lower portion of blank 70 includes panels 74, 78, 80, 82, 84, and 86. The middle portion of blank 70 includes panels 88, 90, 92, 94, and 102. The upper portion of blank 70 includes panels 96, 102, and 104. Panels 88 and 96 are of irregular hexagonal shape.

Referring now to FIG. 7, the blank of FIG. 6 has been partially erected and glued. FIG. 8 shows the configuration of the carton of FIG. 7 after the right hand portion has been swung up, with panels 94 glued to respective panels 82. Also, panel 90 has been glued to a respective side wall panel 94, with panels 86 glued to respective panels 82. The completed or final configuration of the cigarette container according to this second embodiment is illustrated at FIG. 8, with tongue closure panel 104 being adhered, as by glue, to the upper portion of front wall panel 74. FIG. 9 illustrates the several panels taken in section.

Referring now to FIG. 10, the container of FIG. 8 has been opened by pulling up on tongue panel 104, ripping along perforated lines 98 to thereby open the carton to gain access to its contents. Panels 80 and 102, glued together, remain horizontal after ripping of panel 96. After an initial dispensing of cigarettes from the container, top closure panel 96 is swung down, with tongue 104 pushed in surface contact with the inside surface of front panel 74. Subsequent reopenings and reclosing of the container are effected by pushing up on the top of panel 104, from the configuration shown at 11, to open the carton and it is reclosed in the same manner as previously described.

As is conventional in the cigarette container forming art, the containers of this invention are formed using a mandrel. The specific transverse hexagonal shape has been found to yield a less bulging appearance when placed in the shirt pocket.

It will be understood that the several terms of orientation, such as upper, lateral, and the like have been employed in both the specification and claims to facilitate the description of the invention and are not intended as terms of limitation. Further, the reference numerals which appear in the claims, corresponding to those used in the specification, are to facilitate an understanding and are not intended as limiting.

I claim:

1. A unitary paperboard blank (70) for forming a cigarette container, said blank being generally rectangular and having a vertical axis (72), the blank having a lower portion, a middle portion, and an upper portion, A. said lower portion including a front wall forming panel (74), a first pair of lower lateral panels (78) foldably secured to respective sides of said front wall forming panel (74), a second pair of lower lateral panels (82) each secured to respective sides of respective said first lower lateral panels (78), lower first upper panels (84) foldably secured to respective ends of said lower first lateral panels (78), lower second upper panels (86) foldably secured to respective said lower first upper panels (84), B. said middle portion including a bottom forming panel (88), a pair of first middle lateral panels (90) foldably secured to respective sides of said bottom forming panel (88), a rear wall forming panel (92) foldably secured to said bottom forming panel (88), a pair of middle lateral panels (94) foldably secured to respective sides of said rear wall forming panel (92), each of a pair of second middle lateral panels (102) foldably secured to each of said middle lateral panels (94), c. said upper blank portion including a top closure panel (96) foldably secured to said rear wall forming panel (92), each of a first pair of upper lateral panel portions (100) defined by respective vertical perforated lines (98) in said top closure panel (96), a tongue panel (104) foldably secured to said top closure panel (96).

2. The blank of claim 1 wherein said bottom forming panel (88) and said top closure panel (96) are each of irregular hexagonal shape.

3. The blank of claim 1 wherein said front wall forming panel (74) has a lower free edge provided with a recess (76).

4. The blank of claim 1 wherein said front wall forming panel (74) is narrower than said rear wall forming panel.

5. The blank of claim 4 wherein said perforated lines (98) are spaced apart a distance which is substantially equal to the width of said front wall forming panel (74).

6. The blank of claim 1 wherein said bottom forming panel (88) is of irregular hexagonal shape.

7. The blank of claim 1 including a lowermost tab (80) foldably secured to a respective lowermost portion of each of said first lower lateral panels (78).

8. A vertically standing cigarette container formed of a unitary blank of paperboard and of generally rectangular parallelepiped shape, said container being of irregular hexagonal transverse cross section, said container having:

A. a front portion including a front wall panel (74), a pair of first front lateral panels (78) foldably secured to respective sides of said front wall panel (74), said front wall panel (74) having a recess (76) at its upper portion, a pair of second front lateral panels (82) each secured to respective sides of respective said first front lateral panels (78), lower first front panels (84) foldably secured to respective lower ends of said first front lateral panels (78), lower second front panels (86) foldably secured to respective said second lower first front panels (84), the upper ends of said first front lateral panels (78) each carrying a front upper tab (80), B. a bottom forming panel (88), a pair of bottom lateral panels (90) foldably secured to respective ends of said bottom forming panel (88), C. a rear wall panel (92) foldably secured to said bottom forming panel (88), a pair of rear lateral panels (94) foldably secured to respective sides of said rear wall panel (92), each of a pair of second rear lateral panels (102) foldably secured to upper portions of respective ones of said pair of rear lateral panels (94), D. a top closure construction including a top closure panel (96) foldably secured to the upper portion of said rear wall panel (92), each of a first pair of top lateral panel portions (100) defined by respective perforated lines (98) in said top closure panel (96), a tongue panel (104) foldably secured to said top closure panel (96), said tongue panel (104) releasably secured to the upper exterior surface of said front wall panel (74), E. each of said second front lateral panels (82) being in substantial surface contact with a respective said first rear lateral panel (94), said lower second front panels (86) being in surface contact with respective lower portions of said second front lateral panels (82), each of said top lateral panel portions (100) being in surface contact with a respective said front upper tap (80) said tongue panel (104) adapted to be pulled off of said front wall panel (74) to rip said perforated lines (98) to thereby gain access to the container interior, whereby said tongue (104) can be repositioned so as to lie in surface contact with the interior surface of said front wall panel (74), with a vertically extending portion of said tongue panel (104) visible through said resess (76) of said front wall panel (74).

9. The container of claim 8 wherein said second rear lateral panels (102) are in surface contact with respective front upper tabs (80).

* * * * *